US009856763B2

(12) United States Patent
Kira

(10) Patent No.: US 9,856,763 B2
(45) Date of Patent: Jan. 2, 2018

(54) OIL SUPPLY STRUCTURE OF INTERNAL COMBUSTION ENGINE

(71) Applicant: AISIN SEIKI KABUSHIKI KAISHA, Kariya-shi, Aichi-ken (JP)

(72) Inventor: Naoki Kira, Nagoya (JP)

(73) Assignee: AISIN SEIKI KABUSHIKI KAISHA, Kariya-shi, Aichi-ken (JP)

( * ) Notice: Subject to any disclaimer, the term of this patent is extended or adjusted under 35 U.S.C. 154(b) by 63 days.

(21) Appl. No.: 15/148,614

(22) Filed: May 6, 2016

(65) Prior Publication Data

US 2016/0326921 A1 Nov. 10, 2016

(30) Foreign Application Priority Data

May 8, 2015 (JP) ..... 2015-095572

(51) Int. Cl.

| | |
|---|---|
| ***F01M 11/02*** | (2006.01) |
| ***F01M 9/10*** | (2006.01) |
| ***F01M 1/02*** | (2006.01) |
| ***F02F 7/00*** | (2006.01) |
| ***F01M 1/08*** | (2006.01) |

(52) U.S. Cl.

CPC ..... *F01M 9/101* (2013.01); *F01M 1/02* (2013.01); *F01M 1/08* (2013.01); *F02F 7/006* (2013.01); *F01M 9/102* (2013.01); *F01M 9/105* (2013.01); *F01M 11/02* (2013.01); *F01M 2001/0269* (2013.01)

(58) Field of Classification Search

CPC ..... F01M 9/101; F01M 9/102; F01M 9/105; F01M 11/02

USPC ..... 123/90.34

See application file for complete search history.

(56) References Cited

FOREIGN PATENT DOCUMENTS

| | | |
|---|---|---|
| JP | 2007-127014 A | 5/2007 |
| JP | 2007-38845 A | 2/2008 |

*Primary Examiner* — Jorge Leon, Jr.

(74) *Attorney, Agent, or Firm* — Buchanan Ingersoll & Rooney PC

(57) ABSTRACT

A oil supply structure of an internal combustion engine, includes: an oil flowing path which is formed to extend along a camshaft vertically above at least one of intake and exhaust camshafts (3*a*, 3*b*) of the internal combustion engine, and in which oil flows; an oil supply portion provided on one end side of the oil flowing path, and supplying oil to the oil flowing path; and oil ejection holes aligned along the oil flowing path, provided to be opened vertically downward, and through which the oil of the oil flowing path is ejected toward the camshaft, wherein, in the oil flowing path, a partitioning portion, which extends along the oil ejection holes toward the other end side opposite to the oil supply portion from one end side, and partitions the inside of the oil flowing path, is provided.

10 Claims, 7 Drawing Sheets

(SECTION ALONG LINE 150-150 IN FIG. 3)

(FIRST EMBODIMENT)

(SECTION ALONG LINE 150-150 IN FIG. 3)

(FIRST EMBODIMENT)

(FIRST EMBODIMENT)

(SECOND EMBODIMENT)

(SECOND EMBODIMENT)

(THIRD EMBODIMENT)

OIL SUPPLY STRUCTURE OF INTERNAL COMBUSTION ENGINE

CROSS REFERENCE TO RELATED APPLICATIONS

This application is based on and claims priority under 35 U.S.C. §119 to Japanese Patent Application 2015-095572, filed on May 8, 2015, the entire contents of which are incorporated herein by reference.

TECHNICAL FIELD

This disclosure relates to an oil supply structure of an internal combustion engine, more specifically, to an oil supply structure of an internal combustion engine provided with an oil flowing path formed above a camshaft.

BACKGROUND DISCUSSION

In the related art, an oil supply structure of an internal combustion engine provided with an oil flowing path formed above a camshaft, is known (for example, refer to JP 2007-127014A (reference 1))

Reference 1 discloses a lubricating oil supply structure (an oil supply structure of an internal combustion engine) which forms an oil flow-path (oil flowing path) inside thereof by bonding resin members to each other that extend along a camshaft of the internal combustion engine, and which includes a plurality of oil ejection holes which are opened toward a camshaft in a bottom portion of the oil flow-path. In the lubricating oil supply structure described in Reference 1, oil (engine oil) flows in the elongated oil flow-path from an oil supply hole provided in one end portion, is supplied to the other end portion opposite to the oil supply hole, and is ejected toward the camshaft from the oil ejection holes disposed in a shape of a row along the oil flow-path.

However, in the oil supply structure of the internal combustion engine described in Reference 1, in the elongated oil flow-path, it is considered that ejection pressure (ejection amount) of the oil varies due to a pressure loss in the oil flow-path, in the oil ejection hole which is close to the oil supply hole provided in one end portion and the oil ejection hole on the other end portion side far from the oil supply hole. Therefore, since it is necessary to supply a larger amount of oil to the oil flow-path in order to ensure the minimum necessary ejection amount in the oil ejection hole on the other end portion side, and there is a problem that the size of an oil pump which becomes a supply source of the oil increases to that extent.

SUMMARY

Thus, a need exists for an oil supply structure of an internal combustion engine which is not susceptible to the drawback mentioned above.

An oil supply structure of an internal combustion engine according to an aspect of this disclosure includes: an oil flowing path which is formed to extend along a camshaft vertically above at least one of an intake camshaft and an exhaust camshaft of the internal combustion engine, and in which oil flows; an oil supply portion which is provided on one end side of the oil flowing path, and supplies oil to the oil flowing path; and a plurality of oil ejection holes which are aligned along the oil flowing path, which are provided to be opened vertically downward, and through which the oil of the oil flowing path is ejected toward the camshaft. In the oil flowing path, a partitioning portion which is formed to extend along the plurality of oil ejection holes toward the other end side opposite to the oil supply portion from one end side, and partitions the inside of the oil flowing path so that the oil supplied from the oil supply portion is distributed to each of the plurality of oil ejection holes.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Hereinafter, embodiments disclosed here will be described based on the drawings.

Embodiment 1

With reference to FIGS. 1 to 4, a configuration of an engine 100 according to a first embodiment disclosed here will be described.

Schematic Configuration of Engine

Figure 1:
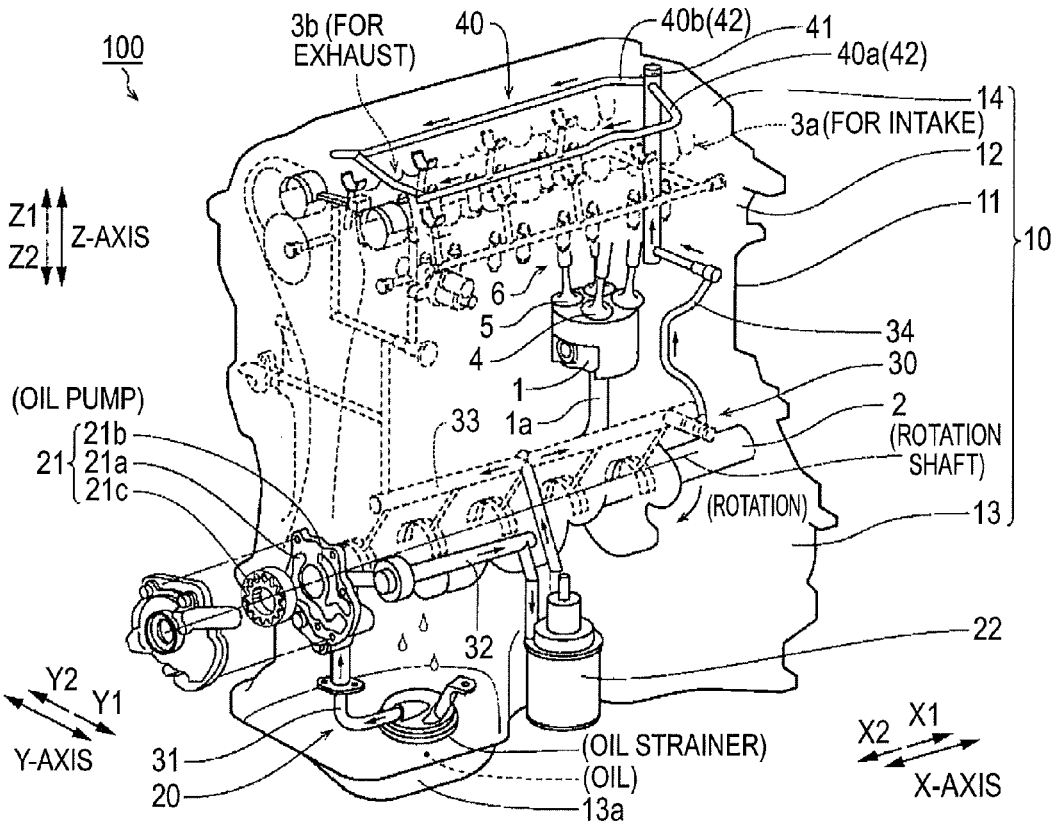
FIG. 1 is a perspective view schematically illustrating an engine and an oil supply device according to a first embodiment disclosed here.

The vehicular (automobile) engine 100 (an example of an internal combustion engine) according to the first embodiment disclosed here has a function of rotating a crank shaft 2 by continuously repeating one cycle of intake, compression, expansion (combustion), and exhaust, as a piston 1 reciprocates in a cylinder, as illustrated in FIG. 1. In addition, the engine 100 has a role of a driving source which makes a vehicle (not illustrated) travel by taking out a driving force from the rotation of the crank shaft 2.

The engine 100 includes an engine main body 10 made of aluminum alloy including cylinder probe 11 which extends in the Z direction; a cylinder head 12 which is fastened to a Z1 side of the cylinder probe 11; and a crank case 13 which is fastened to a Z2 side of the cylinder probe 11. In addition, the cylinder head 12 is covered with a head cover 14. In the engine main body 10, in addition to the piston 1 which generates the driving source, and a connecting rod 1*a* or the crank shaft 2, a valve mechanism (valve gear timing member) 6 which is configured of an intake camshaft 3*a* which controls (adjusts) the explosion timing of mixture in each cylinder and an exhaust camshaft 3*b*, or an intake valve 4 and an exhaust valve 5, is combined with the inside of the cylinder head 12.

In order to continuously drive driving mechanism portions (valve mechanisms 6) on the inside of the engine main body 10, a lubricating device 20 which circulates oil (engine oil) as lubricating oil is provided in the engine 100.

Configuration of Lubricating Device

The lubricating device 20 includes an oil pump 21, and an oil pressure circuit portion 30 for circulating the oil on the inside of the engine main body 10 by the oil pump 21. The oil pump 21 which rotates by using the driving force of the crank shaft 2 has a function of reducing the size of a volume chamber 21*c* and discharging (feeding) the oil from a discharge port 21*b* in a state where predetermined oil pressure is generated, after the intake of the oil from an oil pan 13*a* to the volume chamber 21*c* via an intake port 21*a*.

In addition, as illustrated in FIG. 1, the oil pressure circuit portion 30 includes an oil path 31 which connects the oil pan 13*a* and the intake port 21*a* of the oil pump 21 to each other; an oil path 32 which connects the discharge port 21*b* of the oil pump 21 and an oil filter 22 to each other; and an oil path 33 which connects the oil filter 22 and the inside of the crank shaft 2 to each other. In addition, the oil pressure circuit portion 30 further includes an oil path 34 which extends to above (arrow Z1 direction) from an end portion on an X1 side of the oil path 33 and reaches the inside of the head cover 14 in which the camshaft 3*a* (3*b*) and the valve mechanism 6 are disposed. In addition, an oil supply pipe member 40 which will be described later is attached to a terminal end portion on the downstream side of the oil path 34.

Accordingly, the oil which is pumped up from the oil pan 13*a* by the oil pump 21 flows in the oil paths 31, 32, and 33, and is supplied to a movable portion (slidable portion) around the piston 1 (the inner side surface of the cylinder, or the connecting rod 1*a* and the crank shaft 2). In addition, the oil flows in the oil paths 31, 32, and 34 (oil supply pipe member 40), and is supplied to the camshaft 3*a* (3*b*) and the movable portion (slidable portion) of the valve mechanism 6. After this, the oil automatically falls down in the cylinder head 12 and the cylinder probe 11, reaches the crank case 13, and returns to the oil pan 13*a*.

Configuration of Oil Supply Pipe Member

Figure 3:
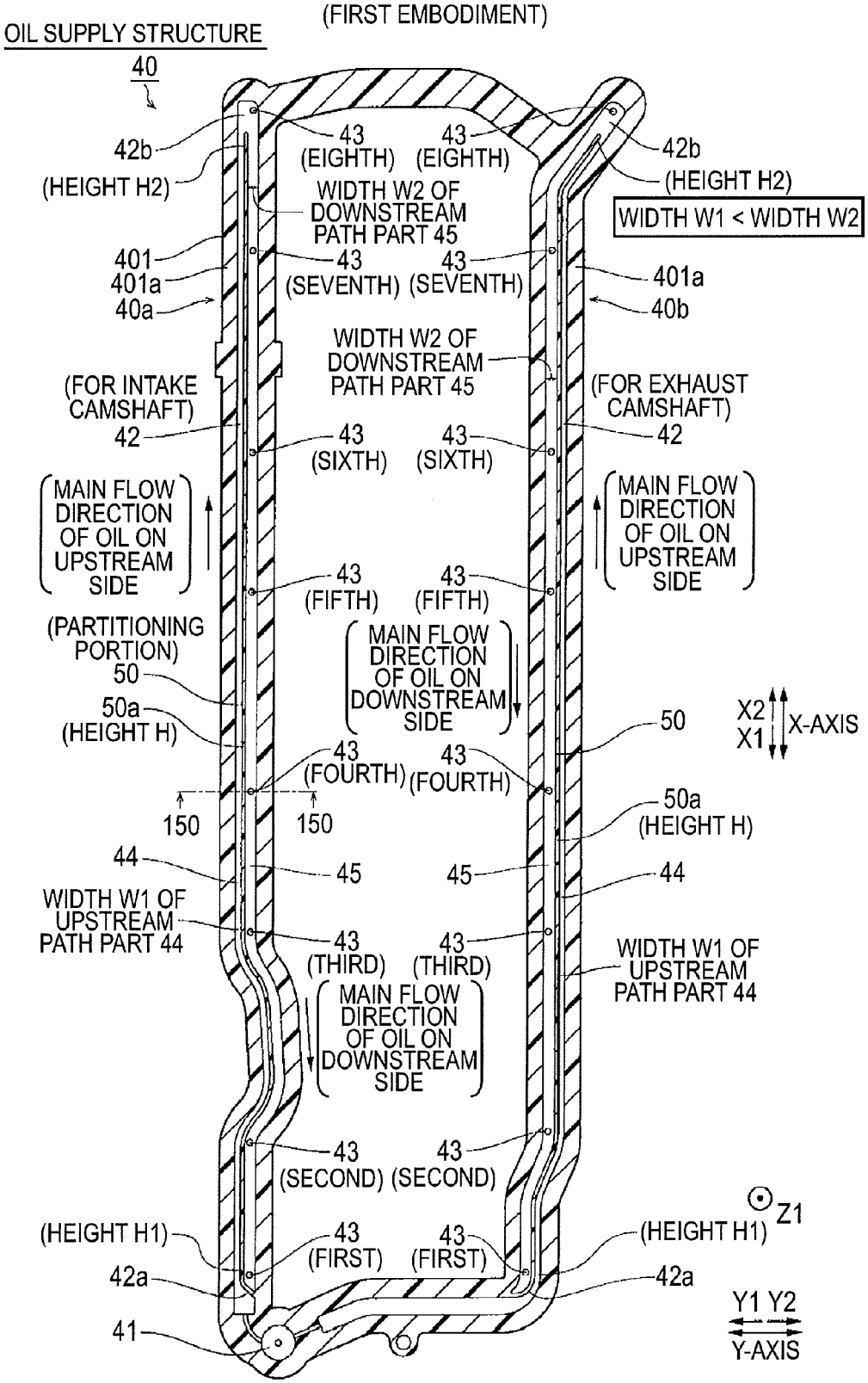
FIG. 3 is a plan view (upper plan view) illustrating a structure of an oil supply pipe member according to the first embodiment disclosed here.

In addition, as illustrated in FIG. 3, the oil supply pipe member 40 includes an oil supply portion 41, one pair of oil flowing paths 42, and a total of 16 oil ejection holes 43 on both sides provided 8 by 8 in each of the oil flowing paths 42. The oil supply portion 41 is positioned in a terminal end portion (on the most upstream side of the oil flowing path 42) on the downstream side of the oil path 34 (refer to FIG. 1), and has a role of supplying the oil (engine oil) to each of one pair of the oil flowing paths 42 which are branched into two. The oil flowing path 42 on one side (Y1 side) branched from the oil supply portion 41, is formed to extend along the camshaft 3*a* vertically above the intake camshaft 3*a*. In addition, the oil flowing path 42 on the other side (Y2 side) branched from the oil supply portion 41 is formed to extend along the camshaft 3*b* vertically above the exhaust camshaft 3*b*.

Figure 2:
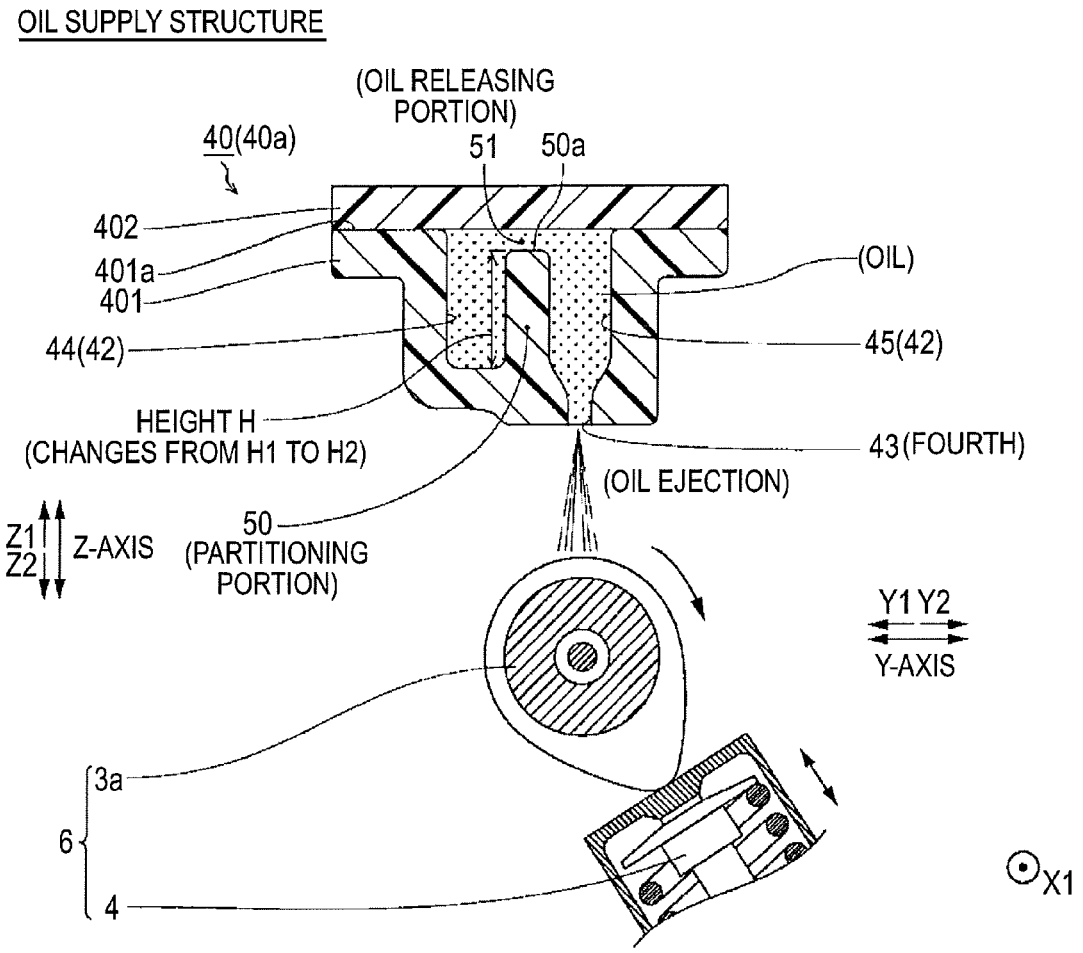
FIG. 2 is a sectional view illustrating an oil supply pipe and a lower structure thereof according to the first embodiment disclosed here.

In addition, as illustrated in FIGS. 2 and 3, the oil ejection hole 43 is provided to be opened vertically downward toward the camshaft 3*a* (3*b*) in each of the oil flowing paths 42. In addition, each of the oil ejection holes 43 is aligned being separated at a disposition interval of the valve mechanism 6 along the oil flowing path 42. Accordingly, the oil which flows in the oil flowing path 42 is ejected toward the camshaft 3*a* (3*b*) from each of the oil ejection holes 43. In addition, the valve mechanism 6 (refer to FIG. 2) is disposed in the camshaft 3*a* (3*b*) immediately below (Z2 side) the oil ejection hole 43.

Structure of Oil Supply Pipe Member

In addition, a structure of the oil supply pipe member 40 will be described. In addition, hereinafter, a part of an oil supply pipe 40*a* which is disposed above the intake camshaft 3*a* in the oil supply pipe member 40, will be described. In other words, since a structure of a part of an oil supply pipe 40*b* which is disposed above the exhaust camshaft 3*b* is substantially similar, the description thereof will be omitted.

As illustrated in FIG. 2, the oil supply pipe member 40 includes a resin-made main body member 401 which is formed to be integrated with the oil flowing path 42, the oil ejection hole 43, and a partitioning portion 50 which will be described later, and a resin-made lid member 402 which is bonded to an upper surface 401*a* of the main body member 401. In other words, as the lid member 402 having a shape of a frame is superimposed and bonded (bonded by using oscillation welding) to the main body member 401 having a shape of a frame (refer to FIG. 3) when viewed in a plan view, in the inner space in which the main body member 401 and the lid member 402 oppose each other, the oil supply portion 41, the oil flowing path 42, the oil ejection hole 43, and the partitioning portion 50 are formed.

Specific Structure of Inside of Each Oil Supply Pipe

Here, in the first embodiment, as illustrated in FIG. 3, in the oil flowing path 42 in the oil supply pipe 40*a*, from one end 42*a* side (X1 side) on which the oil supply portion 41 is disposed, the partitioning portion 50 which extends toward the other end 42*b* side (X2 side) opposite to the oil supply portion 41, is provided. In addition, the partitioning portion 50 extends across seven oil ejection holes including the first to seventh oil ejection holes 43 counting from the X1 side in a side region on the Y1 side of the oil ejection hole 43. In addition, the structure of the oil supply pipe 40*a* (40*b*) in which the partitioning portion 50 is provided in the oil flowing path 42 is an example of an "oil supply structure of an internal combustion engine" disclosed here.

Therefore, the oil flowing path 42 includes an elongated upstream path part 44 which extends to the vicinity of the other end 42*b* along the partitioning portion 50 in the arrow X2 direction from the oil supply portion 41, and a downstream path part 45 which extends toward one end 42*a* along the arrow X1 direction being folded back in the vicinity of the other end 42*b*. In addition, eight of oil ejection holes 43 are opened downward (to a deep side of a paper surface) in a bottom portion of the downstream path part 45. In addition, in the first embodiment, the partitioning portion 50 has a role of partitioning the inside of the oil flowing path 42 so that the oil which flows in the oil flowing path 42 is equivalently distributed to each of all (eight) of the oil ejection holes 43.

In this case, in the first embodiment, the partitioning portion 50 is not configured to be bonded to a lower surface of the lid member 402 while extending upward (vertical direction) from the inner bottom surface of the main body member 401 over the entire forming region (X-axis direction). In other words, in the partitioning portion 50, an oil releasing portion 51 which releases the oil supplied from the oil supply portion 41 to each of the oil ejection holes 43, is provided.

Figure 4:
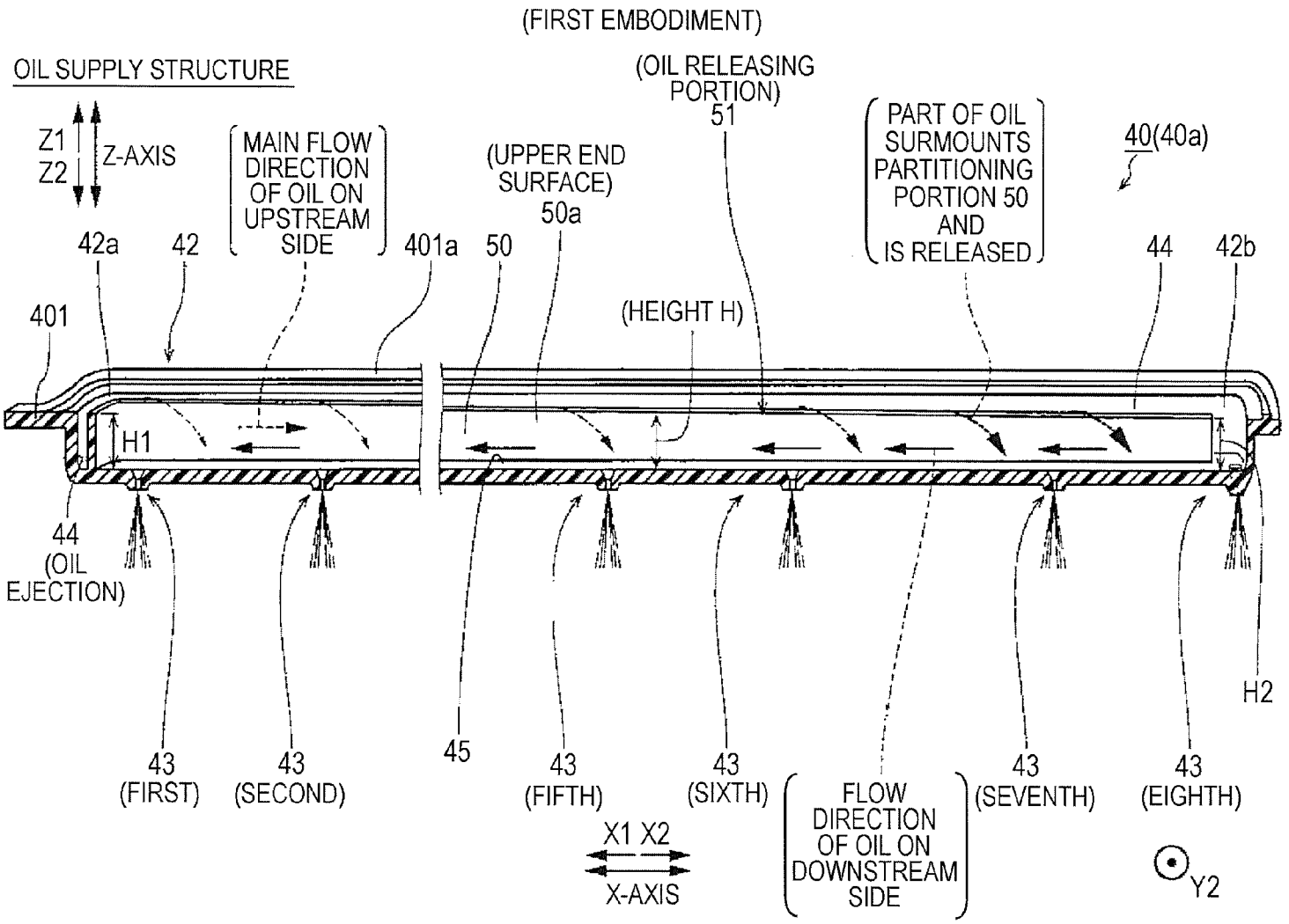
FIG. 4 is a sectional view illustrating a partitioning portion in the oil supply pipe member according to the first embodiment disclosed here.

Specifically, as illustrated in FIG. 4, the oil releasing portion 51 is provided on an upper end surface 50*a* of the partitioning portion 50. In other words, a void part between the upper end surface 50*a* and a lower surface of the lid member 402 corresponds to the oil releasing portion 51. In this case, the height H (the protrusion amount to the lower surface of the lid member 402 from the inner bottom surface of the main body member 401) of the partitioning portion 50 which partitions the inside of the oil flowing path 42 in the height direction (Z-axis direction), is configured to have a certain inclination (a falling gradient in the arrow X2 direction) from the height H1 (the maximum value) at one end 42*a* to the height H2 (the minimum value) at the other end 42*b*, and to gradually decrease. Therefore, the void part (oil releasing portion 51) between the upper end surface 50*a* which is an inclined surface and the lower surface of the lid member 402, is configured to gradually widen toward the other end 42*b* from one end 42*a*.

In addition, in the first embodiment, as illustrated in FIG. 3, the partitioning portion 50 extends to the other end 42*b* side along the remaining seven of the oil ejection holes 43, from a position which corresponds to the (first) oil ejection hole 43 which is the nearest to the oil supply portion 41. In addition, in the oil flowing path 42, the width (groove width) W2 of the downstream side path part 45 which is not provided with the partitioning portion 50, becomes greater than the width (groove width) W1 of the elongated upstream path part 44 provided with the partitioning portion 50.

Accordingly, as illustrated in FIG. 4, the oil supplied from the oil supply portion 41 flows at the upstream path part 44 (width W1) in the arrow X2 direction and reaches the vicinity of the other end 42*b*, and the oil flows at the downstream path part 45 (width W2) being folded back in the arrow X1 direction in the vicinity of the other end 42*b* and is consecutively supplied to eight oil ejection holes including the eighth to first oil ejection holes 43. In addition, at the same time, the oil supplied from the oil supply portion 41 surmounts the upper end surface 50*a* of the partitioning portion 50 in the middle of the upstream path part 44, and is supplied to seven oil ejection holes including the first to seventh oil ejection holes 43 via the oil releasing portion 51 from the upstream path part 44 side.

In this manner, in the oil supply pipe 40*a*, the oil supplied from the oil supply portion 41 is dispersed to all of eight of the oil ejection holes 43 by the path which flows to the upstream path part 44 and the downstream path part 45 along the partitioning portion 50, and the path which flows to the downstream path part 45 via the oil releasing portion 51 (surmounting the partitioning portion 50). At this time, since the height H of the partitioning portion 50 changes from one end 42*a* (height H1) to the other end 42*b* (height H2), while the flowing resistance to the oil ejection hole 43 close to the oil supply portion 41 from the oil supply portion 41 by the part near the upstream side of the partitioning portion 50 becomes relatively high and the releasing amount of the oil decreases, the flowing resistance from the oil supply portion to the oil ejection hole 43 far from the oil supply portion by the part near the downstream side of the partitioning portion 50 becomes relatively low and the releasing amount of the oil increases. Accordingly, regardless whether each of the oil ejection holes 43 is close to or far from the oil supply portion 41 positioned on the most upstream side, the ejection amount (spraying amount) from all of the oil ejection holes 43 is leveled.

In addition, as illustrated in FIG. 3, in the oil supply pipe 40*b* which extends to the opposite side (Y2 side) from the oil supply portion 41, the oil also flows according to a phenomenon similar to the oil supply pipe 40*a*. Accordingly, in the oil supply pipe 40*b*, regardless whether each of the oil ejection holes 43 is close to or far from the oil supply portion 41 positioned on the most upstream side, the ejection amount (spraying amount) from all of the oil ejection holes 43 is leveled. The oil supply structure (oil supply pipe member 40) of the engine 100 in the first embodiment is configured as described above.

Effects of First Embodiment

In the first embodiment, the following effects can be achieved.

In the first embodiment, the partitioning portion 50 which is formed to extend along seven of the oil ejection holes 43 toward the other end 42*b* from one end 42*a* side, and partitions the inside of the oil flowing path 42 so that the oil supplied from the oil supply portion 41 is distributed to each of eight of the oil ejection holes 43, is provided in the oil flowing path 42. Accordingly, in the process in which the oil supplied from the oil supply portion 41 provided on one end 42*a* side of the oil flowing path 42 flows in the oil flowing path 42, it is possible to adjust the flowing resistance (pressure loss) to each oil ejection hole 43 of the oil dispersed in the oil flowing path 42 by the partitioning portion 50. In other words, regardless whether each of the oil ejection holes 43 is close to or far from the oil supply portion 41 positioned on the most upstream side, the oil pressure can equivalently act with respect to each oil ejection hole 43. Accordingly, it is not necessary to increase the entire oil pressure in the oil flowing path 42 so that the oil having a regulated amount is ejected from the oil ejection hole 43 which is the farthest from the oil supply portion 41, and the oil supply pipes 40*a* and 40*b* (oil flowing path 42) can be configured to eject the oil by the minimum necessary ejection amount (spraying amount) from any oil ejection hole 43. As a result, it is possible to reduce the size of the oil pump 21 without excessive capacity of the oil pump 21. In addition, since the valve mechanism 6 can leave the spraying amount itself which can be sufficiently lubricated to the minimum amount, it is possible to reduce the size of the oil supply pipe member 40.

In addition, in the first embodiment, the oil releasing portion 51 which releases the oil supplied from the oil supply portion 41 to the oil ejection hole 43 is provided in the partitioning portion 50. Accordingly, it is possible to adjust the flowing resistances (pressure loss) to each of the oil ejection holes 43 of the oil supplied from the oil supply portion 41 provided on one end 42*a* side of the oil flowing path 42, to be equivalent to each other by using the partitioning portion 50 and the oil releasing portion 51 provided in the partitioning portion 50. Accordingly, even in a case where the elongated oil flowing path 42 is formed to extend along the camshaft 3*a* (3*b*), it is possible to easily obtain the oil supply pipe member 40 (oil supply pipes 40*a* and 40*b*) of the engine 100 which can eject the oil having the minimum necessary ejection amount (spraying amount) in which the oil pressures (ejection amount) are equivalent to each other, from each of the oil ejection holes 43.

In addition, in the first embodiment, the oil releasing portion 51 is provided on the upper end surface 50*a* of the partitioning portion 50, and the height H of the upper end surface 50*a* of the partitioning portion 50 which partitions the inside of the oil flowing path 42 in the height direction gradually decreases from the height H1 of one end 42*a* to the height H2 of the other end 42*b*. Accordingly, it is possible to easily reduce the releasing amount of the oil by increasing the flowing resistance to the oil ejection hole 43 close to the oil supply portion 41 from the oil supply portion 41 by the part near the upstream side of the partitioning portion 50 having the high height H (the protrusion amount above the partitioning portion 50), to be relatively high. On the contrary, it is possible to easily increase the releasing amount of the oil by decreasing the flowing resistance to the oil ejection hole 43 far from the oil supply portion by the part near the downstream side of the partitioning portion 50 having the low height H (protrusion amount), to be relatively low. Accordingly, it is possible to easily correct (level) imbalance of the flowing resistance (pressure loss) in the oil flowing path 42.

In addition, in the first embodiment, the oil flowing path 42 is configured so that the width (groove width) W2 of the downstream path part 45 provided with the oil ejection hole 43 is greater than the width (groove width) W1 of the upstream path part 44 provided with the partitioning portion 50. Accordingly, since it is possible to reduce the flowing resistance (pressure loss) of the oil which flows at the downstream path part 45 that is provided with the oil ejection hole and has the relatively large width W2, to be lower than the flowing resistance of the oil which flows at the upstream path part 44 that is provided with the partitioning portion 50 and has the relatively small width W1, it is possible to easily distribute the oil to each of the oil ejection holes 43 as much as the width (flow-path section) widens at the downstream path part 45.

Second Embodiment

Next, with reference to FIGS. 1, 3, 5, and 6, a second embodiment will be described. In the second embodiment, an example which is different from the above-described first embodiment, and in which an oil releasing path 52 which divides a partitioning portion 250 is provided at a predetermined position in the partitioning portion 250 having similar height, is described. In addition, in the drawings, configuration elements which are similar to those in the above-described first embodiment are given the same reference numerals.

Structure of Oil Supply Pipe Member

Figure 6:
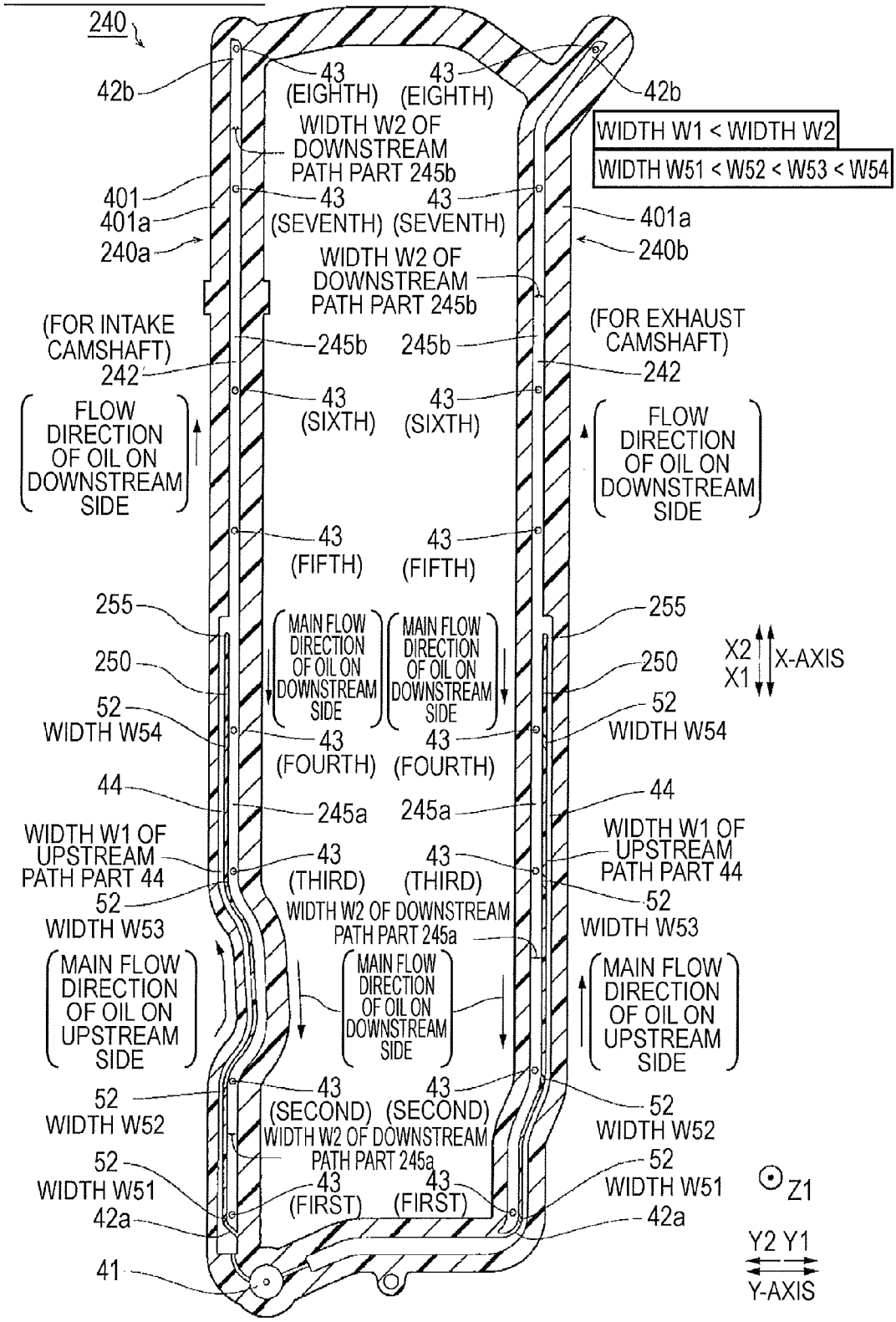
FIG. 6 is a plan view (upper plan view) illustrating a structure of the oil supply pipe member according to the second embodiment disclosed here.

In the oil supply structure of the engine in the second embodiment disclosed here, as illustrated in FIG. 6, an oil supply pipe member 240 is attached to the terminal end portion on the downstream side of the oil path 34 (refer to FIG. 1). In addition, an outer shape of the oil supply pipe member 240 is similar to the oil supply pipe member 40 (refer to FIG. 3). In addition, the oil supply pipe member 240 includes the oil supply portion 41, one pair of oil flowing paths 242, and a plurality (16 in total) of the oil ejection holes 43. In addition, the oil supply pipe member 240 is configured of oil supply pipes 240*a* and 240*b*.

Specific Structure of Inside of Each Oil Supply Pipe

In the oil flowing path 242 in the oil supply pipe 240*a*, the partitioning portion 250 which extends across the first to the fourth oil ejection holes 43 along the arrow X2 direction from one end 42*a* side (X1 side) in which the oil supply portion 41 is disposed, is provided. In addition, the partitioning portion 250 includes a termination portion 255 which terminates in the center portion of the oil supply pipe 240*a*. Therefore, the partitioning portion 250 is not provided along the fifth to the eighth oil ejection holes 43 counting from the X1 side. In addition, the structure of the oil supply pipes 240*a* and 240*b* provided with the partitioning portion 250 in the oil flowing path 242 is an example of the "oil supply structure of the internal combustion engine" disclosed here.

Accordingly, the oil flowing path 242 includes the elongated upstream path part 44 which extends to the center portion along the partitioning portion 250 from the oil supply portion 41; a downstream path part 245*a* which extends toward one end 42*a* being folded back in the center portion; and a downstream path part 245*b* which further extends in the arrow X2 direction from the center portion and reaches the vicinity of the other end 42*b*.

Here, in the second embodiment, the partitioning portion 250 includes the oil releasing path 52 (an example of the oil releasing portion) which releases the oil supplied from the oil supply portion 41 to the vicinity of the first to the fourth oil ejection holes 43.

Figure 5:
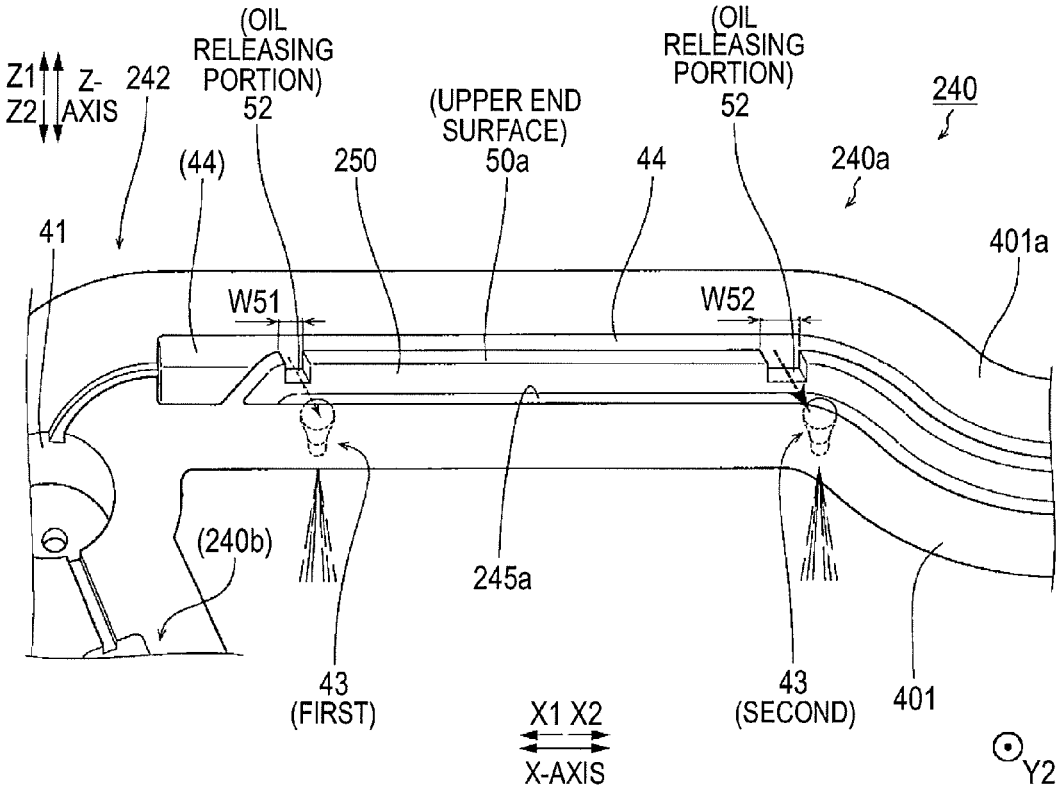
FIG. 5 is a perspective view illustrating a structure of an oil supply pipe member according to a second embodiment disclosed here.

Specifically, as illustrated in FIG. 5, the oil releasing path 52 is formed in a shape of a groove to divide the partitioning portion 250 to be positioned in the vicinity (slightly upstream side) of each of the first to the fourth oil ejection holes 43 counting from the X1 side. In addition, the widths (groove widths) W51 to W54 (refer to FIG. 6) of the oil releasing path 52 having a shape of a groove, are configured to be smaller than the width W1 of the upstream path part 44 of the oil flowing path 242 except the oil releasing path 52, and the width W2 of the downstream path part 245*a* (245*b*). Furthermore, when approaching the center portion from one end 42*a* side in the oil flowing path 242, the widths W51 to W54 (refer to FIG. 6) of the oil releasing path 52 is configured to consecutively widen. In other words, the width (groove width) W51 of the oil releasing path 52 which corresponds to the first oil ejection hole 43 that is the closest to one end 42*a* side in the oil flowing path 242, is the narrowest (smallest), and the width (groove width) W52 of the oil releasing path 52 which corresponds to the adjacent second oil ejection hole 43 in the arrow X2 direction is wider (greater) than the width W51. In addition, as illustrated in FIG. 6, the width (groove width) W54 of the oil releasing path 52 which corresponds to the fourth oil ejection hole 43 that is the closest to the center portion in the oil flowing path 242, is configured to be the widest among the widths W51 to W54.

In addition, as illustrated in FIGS. 5 and 6, each of the oil releasing paths 52 divides the partitioning portion 250 toward the downstream side from the upstream side in the oblique direction. In addition, the oil ejection hole 43 is disposed on an extending line on the downstream side of each of the oil releasing paths 52.

Accordingly, the oil supplied from the oil supply portion 41 flows at the upstream path part 44 (width W1) in the arrow X2 direction and reaches the vicinity of the center portion, and flows at the downstream path part 245*a* (width W2) being folded back in the arrow X1 direction and is consecutively supplied to the fourth to the first oil ejection holes 43. In addition, at the same time, as illustrated in FIG. 5, the oil supplied from the oil supply portion 41 is supplied to 4 first to fourth oil ejection holes 43 via the oil releasing path 52 (widths W51 to W54<width W1<width W2: refer to FIG. 6) of the partitioning portion 250 in the middle of the upstream path part 44.

In this manner, in the oil supply pipe 240*a*, the oil supplied from the oil supply portion 41 is dispersed to four oil ejection holes including the fourth to first oil ejection holes 43 by the path which flows to the upstream path part 44 and the downstream path part 245*a* along the partitioning portion 250, and the path which flows to the downstream path part 245*a* via the oil releasing path 52. At this time, since the width of the oil releasing path 52 changes (increases) to the other end 42*b* (width W54) from one end 42*a* (width W51), while the flowing resistance to the oil ejection hole 43 close to the oil supply portion 41 from the oil supply portion 41 by the part near the upstream side of the partitioning portion 250 increases to be relatively high and the releasing amount of the oil decreases, the flowing resistance to the oil ejection hole 43 farther from the oil supply portion by the part near the downstream side of the partitioning portion 250 decreases to be relatively low and the releasing amount of the oil increases. Accordingly, regardless whether each of the oil ejection holes 43 is close to or far from the oil supply portion 41 positioned on the most upstream side, the ejection amount (spraying amount) from four oil ejection holes including the first to fourth oil ejection holes 43 is leveled.

In addition, as illustrated in FIG. 6, the oil which does not flow to the downstream path part 245*a* further flows at the downstream path part 245*b* (width W2) in the arrow X2 direction from the vicinity of the center portion, and is consecutively supplied to four oil ejection holes including the fifth to eighth oil ejection holes 43. At this time, in the second embodiment, the width W2 of the downstream path part 245*b* which is not provided with the partitioning portion 250 is greater than the width W1 of the upstream path part 44 provided with the partitioning portion 250 (W1<W2). Therefore, the oil which flows to the downstream path part 245*b* (width W2) from the vicinity of the center portion is consecutively supplied to four oil ejection holes including the fifth to eighth oil ejection holes 43 in a state where the flowing resistance is reduced to be lower than that of the upstream path part 44. According to this, in the oil supply pipe 240*a*, regardless whether each of the oil ejection holes 43 is close to or far from the oil supply portion 41 positioned on the most upstream side, the ejection amount (spraying amount) from eight oil ejection holes including the first to eighth oil ejection holes 43 is leveled.

In addition, as illustrated in FIG. 6, in the oil supply pipe 240*b* which extends to the opposite side (Y2 side) from the oil supply portion 41, the oil flows according to a phenomenon similar to the oil supply pipe 240*a*. Accordingly, in the oil supply pipe 240*b*, the ejection amount (spraying amount) from all of the oil ejection holes 43 is leveled. In addition, another configuration of the oil supply pipe member 240 according to the second embodiment is similar to that of the above-described first embodiment.

Effects of Second Embodiment

In the second embodiment, the following effects can be obtained.

In the second embodiment, the plurality of oil releasing paths 52 which divide the partitioning portion 250 to directly guide a part of the oil supplied from the oil supply portion 41 to each of the oil ejection holes 43, are provided. Accordingly, in addition to the oil which flows in the oil flowing path 242 from the oil supply portion 41 and reaches each of the oil ejection holes 43, since it is possible to directly guide a part of the oil which flows in the oil flowing path 242 to the vicinity of the oil ejection hole 43 by the oil releasing path 52 of the partitioning portion 250, it is possible to make the total flowing amounts of the oil which reaches each of the oil ejection holes 43 from the oil supply portion 41 equivalent to each other. Accordingly, it is possible to easily correct imbalance of the flowing resistance (pressure loss) in the oil flowing path 242.

In addition, in the second embodiment, the widths W51 to W54 of the oil releasing path 52 are configured to be smaller than the width W1 of the upstream path part 44 of the oil flowing path 242 except the oil releasing path 52 and the width W2 of the downstream path part 245*a*. Accordingly, it is possible to specifically adjust the amount of the oil which is directly supplied to four oil ejection holes including the first to fourth oil ejection holes 43 from the upstream path part 44 not through the downstream path part 245*a*. In other words, it is possible to effectively prevent imbalance of the dispersing amount (supply amount) to eight oil ejection holes including the first to eighth oil ejection holes 43 in the oil flowing path 242, which is caused by excessive supply of the oil to four oil ejection holes including the first to fourth oil ejection holes 43 via the oil releasing path 52.

In addition, in the second embodiment, the width W51 of the oil releasing path 52 which corresponds to the first oil ejection hole 43 that is the closest to one end 42*a* side in the oil flowing path 242 is the narrowest, and the width W52, the width W53, and the width W54 of the oil releasing paths 52 which correspond to each of the second, the third, and the fourth oil ejection holes 43 that are adjacent in the arrow X2 direction, consecutively widen. Accordingly, it is possible to adjust the oil amount to the oil ejection hole 43 which corresponds to the oil releasing path 52 positioned further on the upstream side among the oil which flows in each oil releasing path 52, to be relatively small (the flowing resistance is relatively high), and the oil amount to the oil ejection hole 43 which corresponds to the oil releasing path 52 positioned further on the downstream side, to be relatively large (the flowing resistance is relatively small). Accordingly, it is possible to easily correct (level) imbalance of the flowing resistance (pressure loss) in the oil flowing path 242. In addition, other effects of the second embodiment are similar to those of the above-described first embodiment.

Third Embodiment

Next, with reference to FIGS. 1, 3, and 7, a third embodiment will be described. In the third embodiment, an example which is different from the above-described second embodiment, and in which the width (groove width) W3 of a downstream path part 345*b* which extends in the arrow X2 direction from the center portion is greater (thicker) than the width (groove width) W2 of the downstream path part 245*b* which extends in the arrow X1 direction from the center portion. In addition, in the drawings, configuration elements which are similar to those in the above-described first embodiment are given the same reference numerals.

Configuration of Oil Supply Pipe Member

Figure 7:
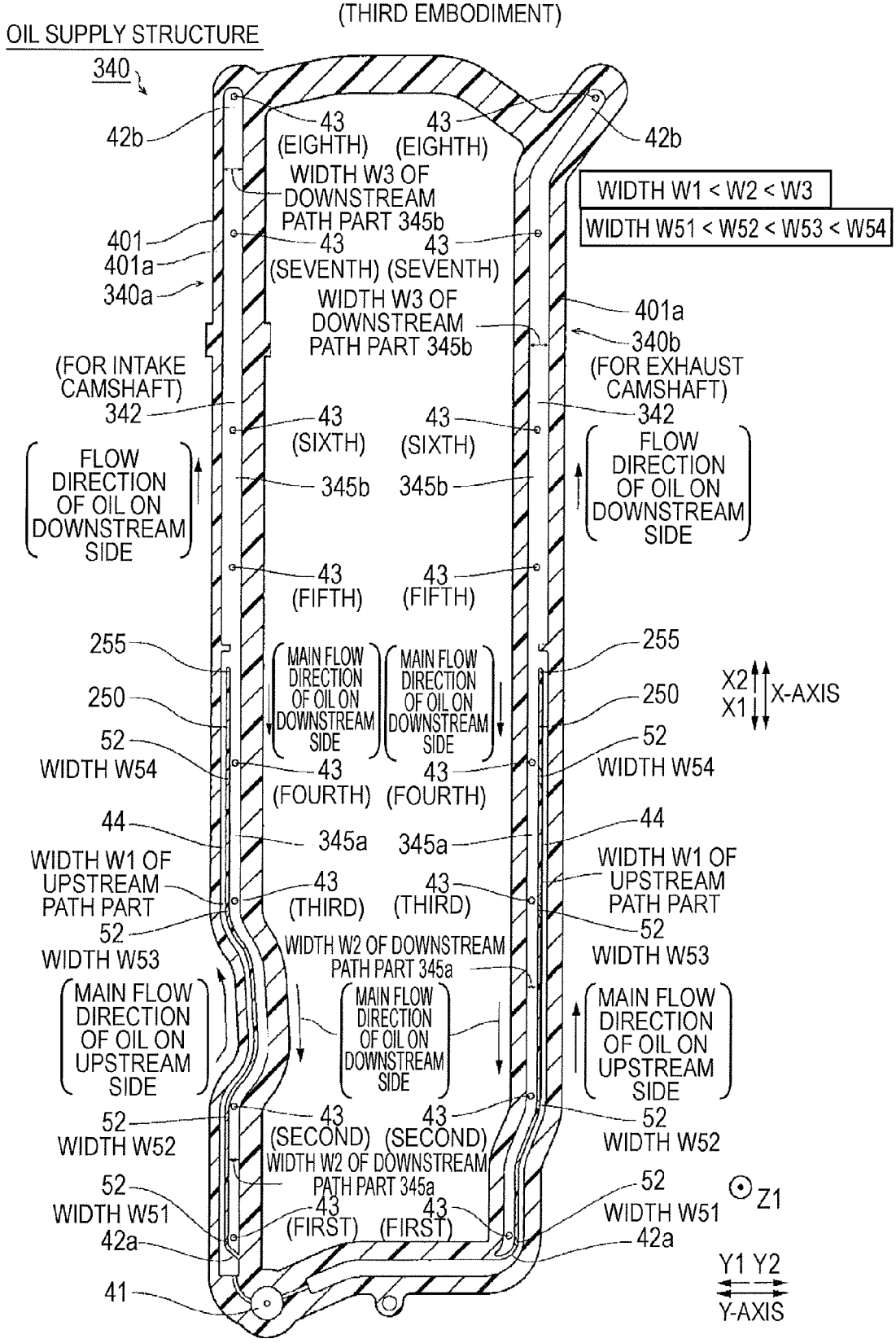
FIG. 7 is a plan view (upper plan view) illustrating a structure of an oil supply pipe member according to a third embodiment disclosed here.

In the oil supply structure of the engine in the third embodiment disclosed here, as illustrated in FIG. 7, an oil supply pipe member 340 is attached to the terminal end portion (refer to FIG. 1) on the downstream side of the oil path 34. In addition, an outer shape of the oil supply pipe member 340 is similar to the oil supply pipe member 40 (refer to FIG. 3). In addition, the oil supply pipe member 340 includes the oil supply portion 41, one pair of oil flowing paths 342, and a plurality (16 in total) of the oil ejection holes 43. In addition, the oil supply pipe member 340 is configured of oil supply pipes 340*a* and 340*b*.

Specific Structure of Inside of Each Oil Supply Pipe

In addition, in the third embodiment, the oil flowing path 342 is configured so that the width W3 of the downstream path part 345*b* which is not provided with the partitioning portion 250 is greater than the width (groove width) W1 of the elongated upstream path part 44 provided with the partitioning portion 250 (W1<W3). In addition, the width W3 of the downstream path part 345*b* which extends in the arrow X2 direction from the center portion is configured to be greater than the width W2 of a downstream path part 345*a* which extends in the arrow X1 direction from the center portion (W2<W3). In addition, the structure of the oil supply pipes 340*a* and 340*b* provided with the partitioning portion 250 in the oil flowing path 342 is an example of the "oil supply structure of the internal combustion engine" of this disclosure.

Accordingly, the oil supplied from the oil supply portion 41 flows at the upstream path part 44 (width W1) in the arrow X2 direction and reaches the vicinity of the center portion, and flows at the downstream path part 345*a* (width W2) being folded back in the arrow X1 direction and is consecutively supplied to the fourth to the first oil ejection holes 43. In addition, a part of the oil further flows at the downstream path part 245*b* (width W2) in the arrow X2 direction from the vicinity of the center portion and is consecutively supplied to four oil ejection holes including the fifth to eighth oil ejection holes 43. At this time, the flowing resistance (pressure loss) of the oil which flows at the downstream path part 345*b* that is provided with the fifth to the eighth oil ejection holes 43 and has the relatively large width W3, decreases to be lower than the flowing resistance (pressure loss) of the oil which flows at the downstream path part 345*a* that is provided with the first to the fourth oil ejection holes 43 and has the relatively small width W2. Therefore, the oil is easily and equivalently distributed to eight oil ejection holes including the first to eighth oil ejection holes 43 as much as the flow-path section (width W3) widens the most at the downstream path part 345*b* which is separated to be far from the oil supply portion 41 in the arrow X2 direction and at which the oil releasing path 52 is not present.

In addition, as illustrated in FIG. 7, in the oil supply pipe 340*b* which extends to the opposite side (Y2 side) from the oil supply portion 41, the oil flows according to a phenomenon similar to the oil supply pipe 340*a*. Accordingly, in the oil supply pipe 340*b*, the ejection amount (spraying amount) from all of the oil ejection holes 43 is leveled. In addition, another configuration of the oil supply pipe member 340 according to the third embodiment is similar to that of the above-described first embodiment.

Effects of Third Embodiment

In the third embodiment, the following effects can be obtained.

In the third embodiment, the oil flowing path 342 is configured so that the width W3 of the downstream path part 345*b* provided with the fifth to the eighth oil ejection holes 43 becomes greater than the width W1 of the upstream path part 44 provided with the partitioning portion 250. Accordingly, it is possible to effectively reduce the flowing resistance (pressure loss) of the oil which flows at the downstream path part 345*b* that is provided with the fifth to the eighth oil ejection holes 43 and has the relatively large width W3, to be lower than the flowing resistance (pressure loss) of the oil which flows at the upstream path part 44 that is provided with the partitioning portion 250 and has the relatively small width W1. Furthermore, it is possible to reduce the flowing resistance (pressure loss) of the oil which flows at the downstream path part 345*b* that is provided with the fifth to the eighth oil ejection holes 43 and has the relatively large width W3, to be lower than the flowing resistance (pressure loss) of the oil which flows at the downstream path part 345*a* that is provided with the first to the fourth oil ejection holes 43 and has the relatively large width W2. In this manner, the oil is easily and equivalently distributed to each of the first to the eighth oil ejection holes 43 as much as the width W3 (flow-path section) widens at the downstream path part 345*b* which is separated to be far from the oil supply portion 41 and at which the oil releasing path 52 is not present. In addition, other effects of the third embodiment are similar to those of the above-described second embodiment.

Modification Example

The embodiments disclosed here are examples in all points, and are considered not to be restricted. The range of this disclosure is not the description of the above-described embodiments, but is illustrated by the range of the appended claims, and further includes the meaning which is equivalent to the range of the appended claims and all changes (modification examples) within the range.

For example, in the above-described first embodiment, the height H of the partitioning portion 50 (upper end surface 50*a*) decreases with a certain inclination from the height H1 of one end 42*a* to the height H2 of the other end 42*b*, but this disclosure is not limited thereto. The upper end surface 50*a* may be formed to be lower in a shape of steps toward the other end 42*b* from one end 42*a*, and according to the characteristics of the pressure loss of the oil, the upper end surface 50*a* may have a curved surface and the height H may decrease from one end 42*a* to the other end 42*b*.

In addition, in the above-described first embodiment, the partitioning portion 50 is formed to extend to the vicinity of the other end 42*b* from one end 42*a* of the oil supply pipe 40*a*, but this disclosure is not limited thereto. For example, the partitioning portion 50 in which the height H gradually decreases may be terminated to the center portion from one end 42*a*.

In addition, in the above-described second embodiment, the partitioning portion 250 including the oil releasing path 52 is provided only from one end 42*a* side to the center portion in the oil supply pipes 240*a* (240*b*), but this disclosure is not limited. In other words, similar to the partitioning portion 50 employed in the above-described first embodiment, the partitioning portion 250 including the oil releasing path 52 may be formed to extend to the vicinity of the other end 42*b* from one end 42*a*. In this case, the oil releasing path 52 which divides the partitioning portion 250 may be provided to be positioned in the vicinity of all of the eight oil ejection holes 43, and in the region in the vicinity of the other end 42*b*, the oil releasing portion may be configured so that the height H simply decreases (gradually changes) without providing the oil releasing path 52.

In addition, in the above-described first embodiment, the partitioning portion 50 in which the height H decreases to the other end 42*b* from one end 42*a* is provided, and in the above-described second embodiment, the partitioning portion 250 including the oil releasing path 52 is provided, but this disclosure is not limited. In other words, the height H may decrease across the entire region of the partitioning portion 50, and may be configured to include the oil releasing path 52.

In addition, in the above-described second and third embodiments, the groove-shaped oil releasing path 52 which divides the partitioning portion 250 is provided, but this disclosure is not limited thereto. A through hole (an example of the oil releasing path) through which the plate-shaped partitioning portion 250 is diagonally penetrated in the thickness direction, may be provided.

In addition, in the above-described first to third embodiments, the width W1 of the upstream path part 44 is constant, but this disclosure is not limited thereto. For example, when the range is smaller than the width W2 or the width W3, the width W1 of the upstream path part 44 may be configured to gradually or step by step increase toward the downstream side. In this case, the thickness (Y-axis direction) of the partitioning portion 50 (250) may be configured to decrease toward the other end 42*b* from one end 42*a*.

In addition, in the above-described first to third embodiments, the partitioning portion 50 (250) which protrudes upward (lid member 402) to the main body member 401 side is integrally provided, but this disclosure is not limited thereto. In other words, the partitioning portion 50 (250) which is suspended downward (main body member 401) to the lid member 402 side may be integrally provided.

In addition, in the above-described first to third embodiments, the resin-made main body member 401 and the lid member 402 are bonded and the oil supply pipe member 40 (240, 340) is formed, but this disclosure is not limited thereto. The oil supply pipe member 40 may be formed by using a metal material (aluminum alloy or the like).

In addition, in the above-described first to third embodiments, this disclosure is employed in the oil supply structure of both the intake camshaft 3*a* and the exhaust camshaft 3*b*, but this disclosure is not limited thereto. In other words, the "oil supply structure of the internal combustion engine" of this disclosure may be disposed vertically above any of the intake camshaft 3*a* and the exhaust camshaft 3*b*.

In addition, the oil supply pipe member which is disposed vertically above the camshafts 3*a* and 3*b* may be configured by the oil supply pipe 40*a* of the above-described first embodiment and the oil supply pipe 240*a* of the above-described second embodiment. Similarly, the oil supply pipe member which is disposed above the camshafts 3*a* and 3*b* may be configured by the oil supply pipe 240*a* of the above-described second embodiment and the oil supply pipe 340*a* of the above-described third embodiment.

In addition, in the above-described first to third embodiments, eight of the oil ejection holes 43 are provided in the oil flowing path 42 on one side in the oil supply pipe member 40, but this disclosure is not limited thereto. It is needless to say that the number of oil ejection holes 43 changes in accordance with the number of cylinders of the internal combustion engine.

In addition, in the above-described first to third embodiments, this disclosure is employed in the lubricating device 20 loaded on the vehicle (automobile) provided with the engine 100, but this disclosure is not limited thereto. This disclosure may be employed in the oil supply structure of the internal combustion engine for installation equipment other than the vehicle. In addition, as the internal combustion engine, a gasoline engine, a diesel engine, and a gas engine and the like can be employed.

An oil supply structure of an internal combustion engine according to an aspect of this disclosure includes: an oil flowing path which is formed to extend along a camshaft vertically above at least one of an intake camshaft and an exhaust camshaft of the internal combustion engine, and in which oil flows; an oil supply portion which is provided on one end side of the oil flowing path, and supplies oil to the oil flowing path; and a plurality of oil ejection holes which are aligned along the oil flowing path, which are provided to be opened vertically downward, and through which the oil of the oil flowing path is ejected toward the camshaft. In the oil flowing path, a partitioning portion which is formed to extend along the plurality of oil ejection holes toward the other end side opposite to the oil supply portion from one end side, and partitions the inside of the oil flowing path so that the oil supplied from the oil supply portion is distributed to each of the plurality of oil ejection holes.

In the oil supply structure of an internal combustion engine according to the aspect of the disclosure, a partitioning portion which is formed to extend along the plurality of oil ejection holes toward the other end side opposite to the oil supply portion from one end side, and partitions the inside of the oil flowing path so that the oil supplied from the oil supply portion is distributed to each of the plurality of oil ejection holes, is provided. Accordingly, in a process in which the oil supplied from the oil supply portion provided on one end side of the oil flowing path flows in the oil flowing path, it is possible to adjust flowing resistances (pressure loss) of the oil dispersed in the oil flowing path to each oil ejection hole by the partitioning portion. In other words, regardless whether each of the oil ejection holes is close to or far from the oil supply portion positioned on the most upstream side, it is possible to make oil pressure equivalently act with respect to each oil ejection hole. Accordingly, it is not necessary to increase the entire oil pressure in the oil flowing path so that the oil having a regulated amount is ejected from the oil ejection hole which is the farthest from the oil supply portion, and it is possible to configure the oil flowing path so that the oil is also ejected by the minimum necessary ejection amount (spraying amount) from any oil ejection hole. As a result, it is possible to achieve the reduction of the size of the oil pump without excessive capacity of the oil pump.

In the oil supply structure of an internal combustion engine according to the aspect of the disclosure, it is preferable that the partitioning portion includes an oil releasing portion which releases the oil supplied from the oil supply portion to the oil ejection hole.

According to this configuration, it is possible to adjust the flowing resistances (pressure loss) of the oil supplied from the oil supply portion provided on one end side of the oil flowing path to each of the oil ejection holes become equivalent to each other by using the oil releasing portion provided in the partitioning portion. Accordingly, even in a case where the oil flowing path is formed in an elongated shape which extends along the camshaft, it is possible to easily obtain the oil supply structure of the internal combustion engine which can eject the oil having the minimum necessary ejection amount (spraying amount) in which the oil pressures (ejection amount) are equivalent to each other, from each of the oil ejection holes.

In the configuration in which the partitioning portion includes the oil releasing portion, it is preferable that the oil releasing portion is provided on an upper end surface of the partitioning portion, and the height of the upper end surface of the partitioning portion which partitions the inside of the oil flowing path in the height direction gradually decreases toward the other end from one end.

According to this configuration, it is possible to easily reduce a releasing amount of the oil by increasing the flowing resistance to the oil ejection hole on the side close to the oil supply portion from the oil supply portion by a part (a part near the upstream side) of the partitioning portion having high height (protrusion amount of the partitioning portion), to be relatively high. On the contrary, it is possible to easily increase the releasing amount of the oil by decreasing the flowing resistance to the oil ejection hole on the side farther from the oil supply portion by a part (part near to the downstream side) of the partitioning portion having low height (protrusion amount), to be relatively low. Accordingly, it is possible to easily correct (level) imbalance of the flowing resistance (pressure loss) in the oil flowing path.

In the configuration in which the partitioning portion includes the oil releasing portion, it is preferable that the oil releasing portion includes an oil releasing path which divides the partitioning portion so that a part of the oil supplied from the oil supply portion is directly guided to the vicinity of the oil ejection hole.

According to this configuration, in addition to the oil which flows in the oil flowing path from the oil supply portion and reaches each oil ejection hole, since it is possible to directly guide a part of the oil which flows in the oil flowing path to the vicinity of the oil ejection hole by the oil releasing path of the partitioning portion, it is possible to make the total flowing amounts of the oil which reaches each of the oil ejection holes from the oil supply portion equivalent to each other. Accordingly, it is possible to easily adjust imbalance of the flowing resistance (pressure loss) in the oil flowing path.

In the oil supply structure of an internal combustion engine according to the aspect of the disclosure, it is preferable that the partitioning portion extends to the other end side along the aligning direction of the plurality of oil ejection holes from a position which corresponds to the oil ejection hole closest to the oil supply portion, and the width of the oil flowing path of a downstream path part provided with the oil ejection hole is greater than the width of the oil flowing path of an upstream path part provided with the partitioning portion.

According to this configuration, since it is possible to reduce the flowing resistance (pressure loss) of the oil which flows at the downstream path part that is provided with the oil ejection hole and has the relatively large width, to be lower than the flowing resistance (pressure loss) of the oil which flows at the upstream path part that is provided with the partitioning portion and has the relatively small width, it is possible to easily distribute the oil to each oil ejection hole as much as the width (flow-path section) widens at the downstream path part.

In addition, in the oil supply structure of the internal combustion engine according to the above-described aspect, the following configuration can also be conceived.

Additional Item 1

In the oil supply structure of an internal combustion engine in which the oil releasing portion includes the oil releasing path, the width of the oil releasing path is smaller than the width of the oil flowing path except the oil releasing path.

Additional Item 2

In the oil supply structure of an internal combustion engine in which the oil releasing portion includes the oil releasing path, the oil releasing path is provided to correspond to each of the plurality of oil ejection holes, and the width of the oil releasing path which corresponds to the oil ejection hole which is close to one end side in the oil flowing path, is smaller than the width of the oil releasing path which corresponds to the oil ejection hole which is close to the other end.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. An oil supply structure of an internal combustion engine, comprising:

an oil flowing path extending along and vertically above at least one of an intake camshaft and an exhaust camshaft of the internal combustion engine, and in which oil flows;

an oil supply portion provided on a first end side of the oil flowing path to supply oil to the oil flowing path; and a plurality of oil ejection holes aligned along the oil flowing path, opening vertically downward, and through which the oil of the oil flowing path is ejected toward the at least one of the intake camshaft and the exhaust camshaft, wherein, in the oil flowing path, a partitioning portion extends along the plurality of oil ejection holes toward a second end side from the first end side, and partitions an inside of the oil flowing path so that the oil supplied from the oil supply portion is distributed to each of the plurality of oil ejection holes.

2. The oil supply structure of an internal combustion engine according to claim 1, wherein the partitioning portion includes an oil releasing portion which releases the oil supplied from the oil supply portion to the plurality of oil ejection holes.

3. The oil supply structure of an internal combustion engine according to claim 2, wherein the oil releasing portion is provided on an upper end surface of the partitioning portion, and wherein a height of the upper end surface of the partitioning portion which partitions the inside of the oil flowing path in a height direction gradually decreases toward the second end side from the first end side.

4. The oil supply structure of an internal combustion engine according to claim 3, wherein the partitioning portion extends to the second end side along an aligning direction of the plurality of oil ejection holes from a position which corresponds to a first of the plurality of oil ejection holes which is closest to the oil supply portion, and wherein a width of the oil flowing path of a downstream path part provided with the first oil ejection hole is greater than a width of the oil flowing path of an upstream path part provided with the partitioning portion.

5. The oil supply structure of an internal combustion engine according to claim 2, wherein the oil releasing portion includes an oil releasing path which divides the partitioning portion so that a part of the oil supplied from the oil supply portion is directly guided to a vicinity of the plurality of oil ejection holes.

6. The oil supply structure of an internal combustion engine according to claim 5, wherein the partitioning portion extends to the second end side along an aligning direction of the plurality of oil ejection holes from a position which corresponds to a first of the plurality of oil ejection holes which is closest to the oil supply portion, and wherein a width of the oil flowing path of a downstream path part provided with the first oil ejection hole is greater than a width of the oil flowing path of an upstream path part provided with the partitioning portion.

7. The oil supply structure of an internal combustion engine according to claim 5, wherein a width of the oil releasing path is smaller than a width of the oil flowing path.

8. The oil supply structure of an internal combustion engine according to claim 2, wherein the partitioning portion extends to the second end side along an aligning direction of the plurality of oil ejection holes from a position which corresponds to a first of the plurality of oil ejection holes which is closest to the oil supply portion, and wherein a width of the oil flowing path of a downstream path part provided with the first oil ejection hole is greater than a width of the oil flowing path of an upstream path part provided with the partitioning portion.

9. The oil supply structure of an internal combustion engine according to claim 1, wherein the partitioning portion extends to the second end side along an aligning direction of the plurality of oil ejection holes from a position which corresponds to a first of the plurality of oil ejection holes which is closest to the oil supply portion, and wherein a width of the oil flowing path of a downstream path part provided with the first oil ejection hole is greater than a width of the oil flowing path of an upstream path part provided with the partitioning portion.

10. The oil supply structure of an internal combustion engine according to claim 1, wherein the partitioning portion includes a plurality of spaced apart oil releasing portions each corresponding to one of the plurality of oil ejection holes, and a width of the oil releasing portion which corresponds to one of the plurality of oil ejection holes which is closest to the first end side in the oil flowing path, is smaller than a width of the oil releasing portion which corresponds to one of the plurality of oil ejection holes which is closest to the second end side.

* * * * *